United States Patent [19]

Schauer et al.

[11] 4,283,354

[45] Aug. 11, 1981

[54] CARBURETOR FOR INTERNAL-COMBUSTION ENGINES

[75] Inventors: Walter Schauer, Neuss; Josef Rösgen, Grevenbroich, both of Fed. Rep. of Germany

[73] Assignee: Pierburg GmbH & Co. KG, Neuss, Fed. Rep. of Germany

[21] Appl. No.: 105,472

[22] Filed: Dec. 19, 1979

[30] Foreign Application Priority Data

Dec. 22, 1978 [DE] Fed. Rep. of Germany ..... 2855683

[51] Int. Cl.[3] ..... F02M 3/08

[52] U.S. Cl. ..... 261/41 D; 261/DIG. 78

[58] Field of Search ..... 261/41 D, DIG. 78

[56] References Cited

U.S. PATENT DOCUMENTS

| | | | |
|---|---|---|---|
| 3,503,594 | 8/1968 | Goto | 261/41 D |
| 3,544,083 | 12/1970 | Currie | 261/DIG. 78 |
| 3,608,874 | 9/1971 | Beckmann | 261/41 D |
| 3,814,389 | 6/1974 | August | 261/DIG. 78 |
| 3,878,271 | 4/1975 | Garcea | 261/41 D |
| 3,931,369 | 1/1976 | Dale et al. | 261/DIG. 78 |
| 3,931,372 | 1/1976 | Pierlot | 261/41 D |

FOREIGN PATENT DOCUMENTS

| | | | |
|---|---|---|---|
| 50-14034 | 4/1975 | Japan | 261/DIG. 78 |

*Primary Examiner*—Tim R. Miles

*Attorney, Agent, or Firm*—Ladas & Parry

[57] ABSTRACT

The ratio air:fuel with a mixture fed to an internal combustion engine is maintained constant independent of the condition of said internal combustion engine in that the mixture is fed supercritically and the air subcritically into a by-pass line bypassing the main choke.

5 Claims, 6 Drawing Figures

CARBURETOR FOR INTERNAL-COMBUSTION ENGINES

Figure 1:
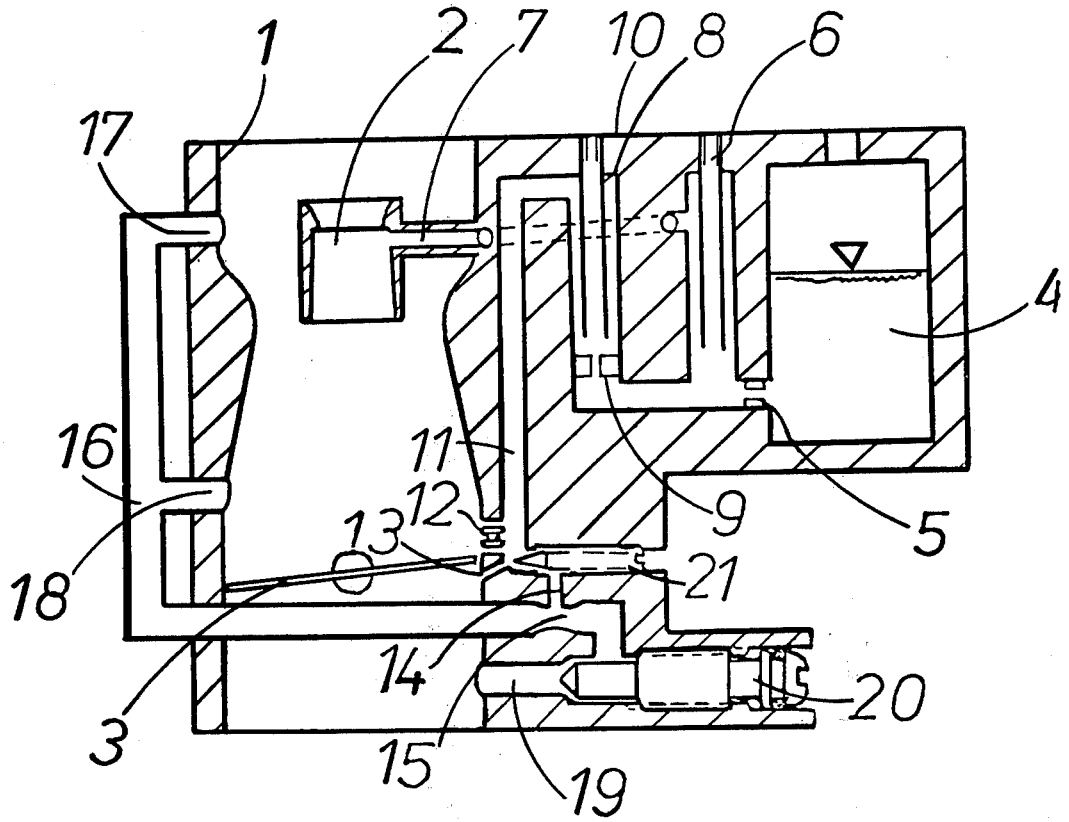

The invention is concerned with a carburetor for internal-combustion engines which has, apart from the main injection system, also a no-load system as well as a bypass system.

The increasing demands which are made for the reduction of harmful exhaust gases of motor vehicles place increasingly more stringent requirements on carburettor designs. To achieve a minimum of harmful exhaust gases, as complete a combustion as possible is necessary, that is the air and fuel must be in the correct ratio in all operating states of the engine. This means that the carburettor must be adjusted very carefully after its manufacture at the factory, that is all the adjustable cross sections must be carefully adapted to one another. Such an adjustment can be made with high precision at the factory, since all the measuring instruments required are available for the purpose. The instruments required for such a precise setting are no longer present for readjustments in workshops or at filling stations and the discharge of harmful substances is naturally higher after settings made in this way. However, such readjustments are unavoidable, in principle, because even in the running-in period of the internal-combustion engine its data changes in such a way that the optimal setting is lost.

The problem of the invention is to design a carburetor so that a setting allowing for the actual running-in state of an engine can be made by the adjustment of a single adjusting screw, so that the adaptation of different adjustable cross sections to one another is omitted. Such a readjustment can then be made with means which are available to any workshop.

With a carburetor of the above-described type this problem is solved due to the fact that the bypass line has a narrow point in which a channel carrying emulsified fuel terminates and that a bore enters the suction pipe from the no-load channel at a point lying downstream of the closed, randomly actuable throttle valve, whereby the cross sections of nozzles and bores determining the supply of emulsified fuel through this bore are adapted so that the fuel supply is effected supercritically, while the cross sections determining the supply of emulsified fuel through the connecting channel to the narrow point of the bypass line are adjusted so that the fuel supply into the bypass line is effected sub-critically.

An especially simple construction is obtained if the emulsified fuel to supply the bypass system is taken from the no-load system.

Figure 2:
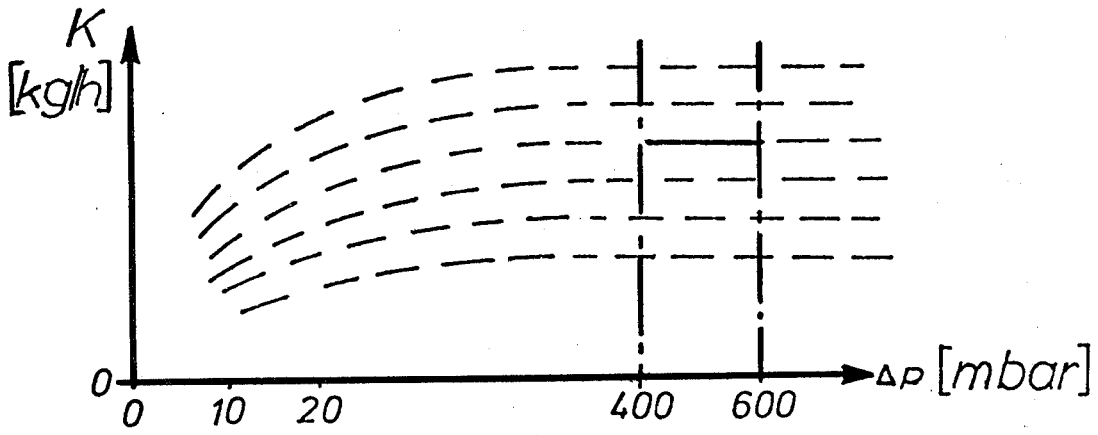
Figure 3:
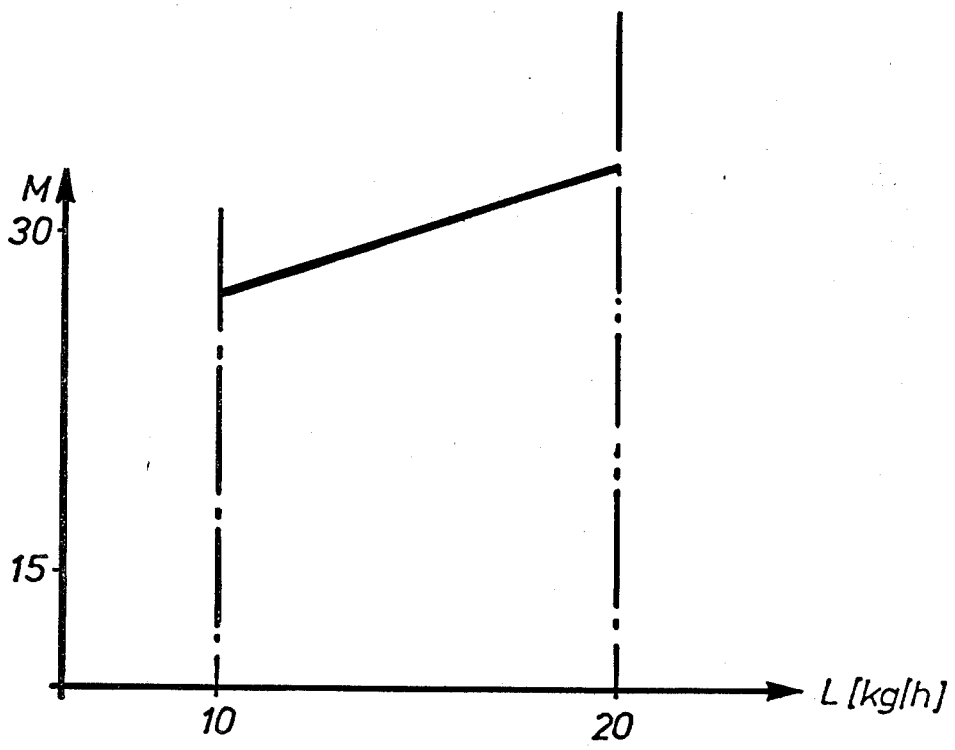
Figure 4:
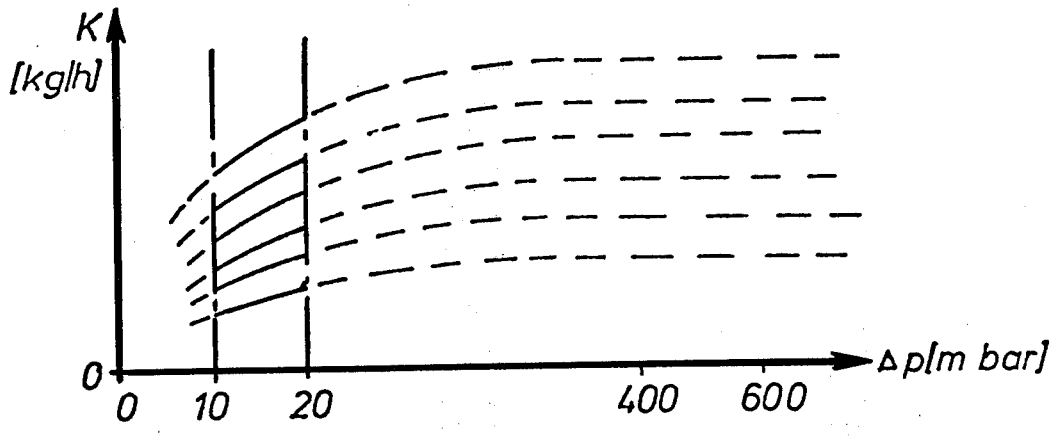
Figure 5:
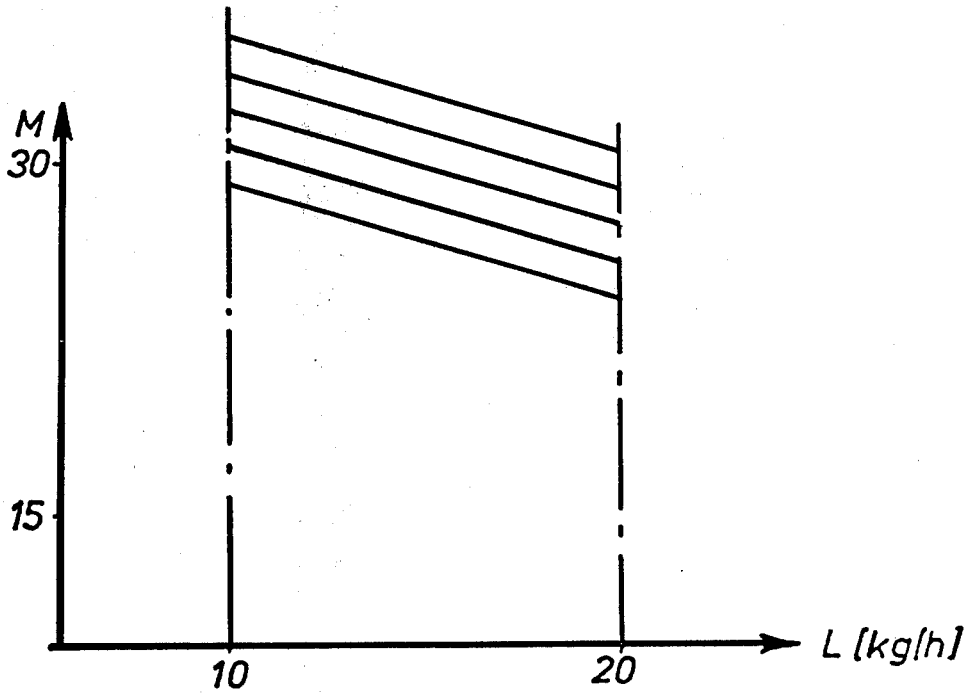
Figure 6:
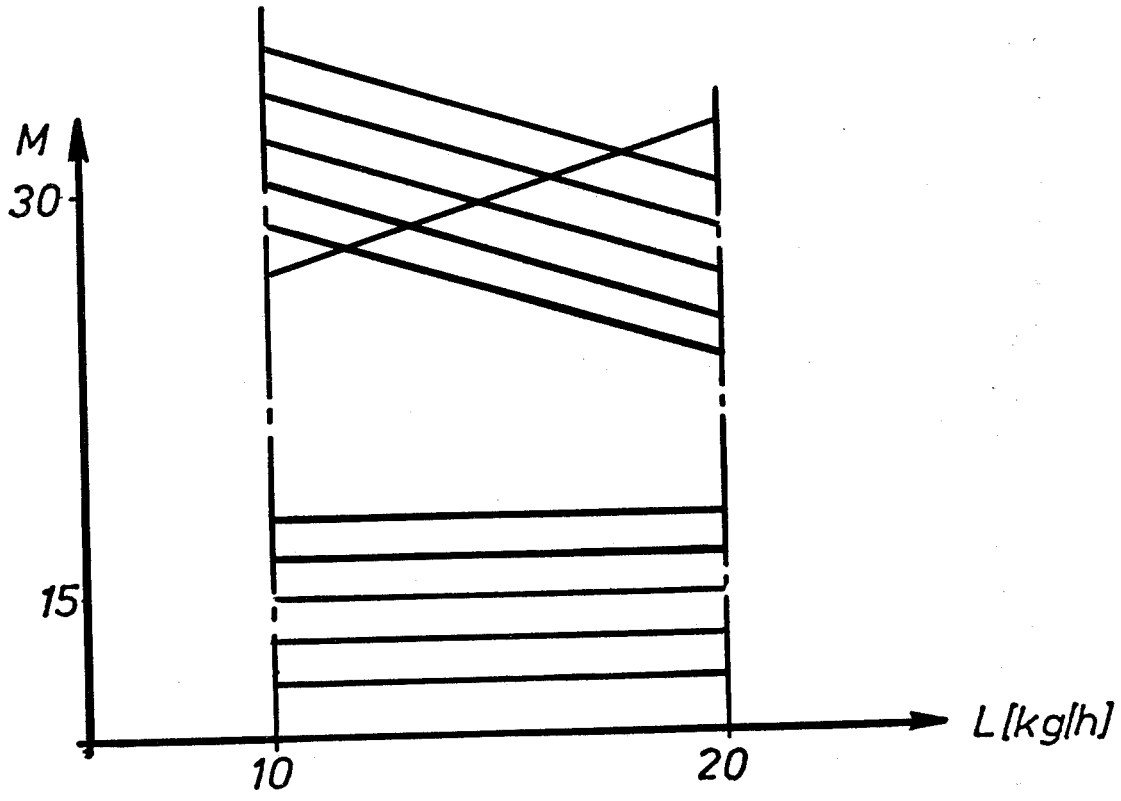

One exemplary embodiment of a carburetor designed according to the invention is described hereinafter by reference to the drawing wherein:

FIG. 1 shows schematically the circuit of the carburetor,

FIG. 2 shows the quantity of fuel flowing hourly out of a bore of the no-load system into the suction pipe as a function of the partial vacuum prevailing in the suction pipe, FIG. 3 shows the dependence on the rate of air flow of the mixture ratio for the fuel supplied by the no-load system, FIGS. 4 and 5 show how the rate of fuel flow and mixture ratio according to FIGS. 2 and 3 behave for the fuel supplied by the bypass system, FIG. 6 shows the behaviour of the mixture ratio as a function of the rate of air flow for the fuel supplied by both systems.

The carburetor contains in a suction pipe 1 a schematically suggested main injection system 2 as well as downstream of the Venturi tube a randomly actuable throttle valve 3. From the fuel tank 4 with a constant level the fuel is supplied via a fuel nozzle 5 to a main emulsifying system 6 from which emulsified fuel is supplied via the line 7 to the main injection system 2. Via the fuel nozzle 5 the no-load emulsifying system 8, also, is supplied via a fuel nozzle 9 with fuel and via an air correcting nozzle 10 with air. The mixture then arrives via the no-load channel 11 at the bores 12 which are arranged in the region of the throttle valve. A bore 13 emerges at a point lying downstream of the closed throttle valve 3 and there branches off from the no-load channel 11 on a level with this bore a connecting channel 14 whose cross section is adjustable by an adjusting screw 21. The connecting channel 14 terminates at a narrow point 15 of a bypass line 16 which departs from the suction pipe 1 either upstream of the Venturi tube of the suction pipe 1 at the point 17 or downstream of this Venturi tube at the point 18 or also from both points and which enters the suction pipe 1 at a point 19 lying downstream of the throttle valve 13. The cross section of this bypass line is adjustable by an adjusting screw 20 which is arranged between the point of emergence of the connecting channel 14 coming from the no-load channel 11 and the outlet of the bypass line into the suction pipe 1.

The mode of action of the above-described carburetor is illustrated by reference to FIGS. 2 to 6.

The partial vacuum at the entry of the bore 13 into the suction pipe 1 is approximately 400 to 600 millibars in the operating range of interest. The nozzles 5 and 6 as well as the diameter of the bore 13 are adjusted to one another so that the rate of fuel flow through the bore 13 is super-critical, that is there is a constant rate of fuel flow in the above-specified pressure range. In FIG. 2 the rate of fuel flow is plotted in kg per hour against the partial vacuum in the suction pipe. FIG. 2 shows that this has the effect on the mixture ratio M, that is on the ratio of air to fuel, that the mixture ratio increases and consequently the fuel proportion decreases with a rising rate of air flow. In FIG. 3 the mixture ratio $M_1$ is plotted against the hourly rate of air flow given in kg. Only a single curve is obtained here.

Fuel is supplied to the suction pipe not only through the bore 13, but also through the bypass line. These ratios are represented in FIGS. 4 and 5. At the narrow point 15 of the bypass line 16 where the connecting channel 14 coming from the no-load system terminates a partial vacuum of approximately 10 to 20 millibars prevails. The cross sections are adapted to one another so that the rate of fuel flow through the channel 11 lies in the sub-critical range, that is the rate of fuel flow increases with rising partial vacuum. The partial vacuum at the narrow point 15 is a dynamic partial vacuum, that is it is determined by the quantity of air flowing through the bypass channel. The quantity of air flowing through the bypass channel is adjustable by the adjusting screw 20 and when this adjusting screw is unscrewed the quantity of air flowing through is increased, due to which the partial vacuum at the narrow point increases and consequently also the quantity of fuel flowing through the channel 14 into the bypass line. FIG. 4 illustrates these ratios, the fuel flowing per hour through the channel 14 being plotted in this Figure against the pressure prevailing at the narrow point 15 of the bypass line. A family of curves is represented in this Figure, each of these curves corresponding to a specific setting of the adjusting screw 21. As can be seen in FIG. 5, this has an influence on the quantity of fuel supplied by the bypass line to the suction pipe 1. In this Figure the mixture ratio $M_2$ is plotted against the hourly rate of air flow given in kg. It will be seen that the mixture ratio decreases with an increasing rate of air flow, that is there is an increasing enrichment of fuel. The individual curves of FIG. 5 correspond to different settings of the adjusting screw 9.

The mixture ratio $M_3$ resulting from the sum of the two fuel supplies is given in FIG. 6, consideration being given to the quantities of fuel which enter the suction pipe through the no-load system according to FIGS. 2 and 3 and through the bypass system according to FIGS. 4 and 5. In this FIG. 6 the mixture ratio $M_3$ is plotted against the total rate of air flow and the individual curves are recorded in the upper part of FIG. 6 and the cumulative curves recorded in the lower part.

It will be seen that the cumulative curves show a division which coincides with the division in FIG. 5. This family of nominal curves consists of parallel straight lines which indicate a constant mixture ratio and it can be seen that it is possible at once for an arbitrarily selected nominal curve to be set.

The idea on which the invention is based can be described by stating that emulsified fuel is supplied by two systems to an internal-combustion engine by a carburetor on no-load, whereby with one system the mixture ratio decreases with an increasing rate of air flow, whereas with the other system the mixture ratio increases with an increasing rate of air flow. These two systems can be adapted to one another so that there is maintained in a relevant range of the rate of air flow a constant mixture ratio whose magnitude can be determined by the adjustment of a single cross section. The supply of both systems with emulsified fuel can be effected in different ways, but one of the existing emulsifying systems, namely a system for no-load running or the emulsifying system provided to supply the main injection system will advantageously be adopted also to supply the bypass system.

A carburetor designed according to the invention offers the advantage that the no-load speed of an internal-combustion engine can be kept constant by a simple adjustment independently of the conditions of friction which differ according to the running-in state. The position of the throttle valve does not need to be changed and the mixture ratio remains constant.

We claim:

1. Carburetor for internal-combustion engines, with a suction pipe with Venturi tube, in which the main injection system terminates, as well as with a randomly actuable throttle valve and a bypass line bypassing this throttle valve as well as with a no-load system which is supplied with emulsified fuel by an emulsifying system and which has bores terminating in the suction pipe in the region of the randomly actuable throttle valve, characterized in that the bypass line (16) has a constant non-adjustable narrow point (15) into which a channel (14) carrying emulsified fuel emerges and in that a bore (13) enters the suction pipe (1) from the no-load channel (11) at a point lying downstream of the closed, randomly actuable throttle valve, and further characterized by an adjusting screw (20) by which the cross section of the bypass line (16) is determined downstream of the narrow point (15) before it enters the suction pipe (1), whereby the cross sections of nozzles and bores determining the supply of emulsified fuel through this bore (13) are adjusted so that the fuel supply is effected super-critically, while the cross sections determining the supply of emulsified fuel through the connecting channel (14) to the narrow point (15) of the bypass line are adapted so that the fuel supply into the bypass line is effected sub-critically.

2. Carburetor according to claim 1, characterised in that the channel (14) emerging at the narrow point (15) of the bypass line (16) is connected to the no-load system (11) via the controllable cross section of an adjusting screw (21).

3. Carburetor according to claim 1, characterised in that the bypass line (16) branches off from the suction pipe (1) at a point lying upstream of the Venturi tube.

4. Carburetor according to claim 1, characterised in that the bypass line (16) branches off from the suction pipe at a point (18) lying downstream of the Venturi tube of the suction pipe (1).

5. Carburetor according to claim 3 or 4, characterised in that the bypass line (16) branches off from the suction pipe (1) both at a point (17) lying upstream and at a point (18) lying downstream of the Venturi tube.

* * * * *